US007837485B2

(12) United States Patent
Epe et al.

(10) Patent No.: US 7,837,485 B2
(45) Date of Patent: Nov. 23, 2010

(54) ELECTRICAL PLUG CONNECTOR HAVING A SLIDER WHICH CONNECTS WITH A CAP UPON THE SLIDER BEING INSERTED INTO A HOUSING TO LATCH THE CAP TO THE HOUSING

(75) Inventors: Peter Epe, Lennestadt (DE); Thomas Foerster, Luedenscheid (DE)

(73) Assignee: Kostal Kontakt Systeme GmbH, Ludenscheid (DE)

( * ) Notice: Subject to any disclaimer, the term of this patent is extended or adjusted under 35 U.S.C. 154(b) by 0 days.

(21) Appl. No.: 12/479,362

(22) Filed: Jun. 5, 2009

(65) Prior Publication Data

US 2009/0263998 A1 Oct. 22, 2009

Related U.S. Application Data

(63) Continuation of application No. PCT/EP2007/063690, filed on Dec. 11, 2007.

(30) Foreign Application Priority Data

Dec. 13, 2006 (DE) ..... 10 2006 058 680

(51) Int. Cl.
*H01R 13/62* (2006.01)

(52) U.S. Cl. ..... 439/157

(58) Field of Classification Search ..... 439/157–160
See application file for complete search history.

(56) References Cited

U.S. PATENT DOCUMENTS 5,618,194 A 4/1997 Maue et al.
5,681,175 A 10/1997 Busse et al.
6,213,795 B1 4/2001 Drescher et al.
6,345,995 B1 2/2002 Bigotto et al.
6,857,885 B2 2/2005 Pade et al.
7,309,253 B2 * 12/2007 Ge et al. ..... 439/500
7,402,070 B1 * 7/2008 Wu ..... 439/352
7,695,297 B2 * 4/2010 Pittenger et al. ..... 439/157
2003/0082940 A1 5/2003 Yamashita
2003/0109155 A1 6/2003 Yamashita
2003/0166350 A1 9/2003 Pade et al.
2005/0221647 A1 10/2005 Dillon et al.
2007/0099461 A1 * 5/2007 Pittenger et al. ..... 439/157
2007/0128900 A1 * 6/2007 Bauman et al. ..... 439/157

(Continued)

FOREIGN PATENT DOCUMENTS

DE 195 11 225 A1 10/1996

(Continued)

*Primary Examiner*—Chandrika Prasad
(74) *Attorney, Agent, or Firm*—Brooks Kushman P.C.

(57) ABSTRACT

An electrical plug connector includes a first connector housing, a slider, and a cap. The slider has slider surfaces insertable into the first housing in a direction transverse to a direction of insertion of a second housing to the first housing at a connecting side of the first housing. The slider is connected to the first housing upon the slider surfaces being inserted into the first housing. The cap is on a cap side of the first housing lying opposite to the connecting side of the first housing. The slider surfaces connect with the cap to latch the cap to the cap side of the first housing upon the slider surfaces being inserted into the first housing.

7 Claims, 2 Drawing Sheets

U.S. PATENT DOCUMENTS

| | | | | |
|---|---|---|---|---|
| 2009/0221167 | A1* | 9/2009 | Pittenger et al. | 439/157 |
| 2010/0159732 | A1* | 6/2010 | Yeh et al. | 439/366 |

FOREIGN PATENT DOCUMENTS

| | | | |
|---|---|---|---|
| DE | 198 44 693 | A1 | 3/2000 |
| DE | 20106746 | U1 | 8/2002 |
| DE | 102 50 415 | A1 | 6/2003 |
| DE | 103 32 894 | A1 | 2/2005 |
| EP | 0722203 | A1 | 7/1996 |
| EP | 08 31 559 | A2 | 3/1998 |
| EP | 1 005 112 | A2 | 5/2000 |

* cited by examiner b)

Detail A b)

Detail B b)

Detail C

ELECTRICAL PLUG CONNECTOR HAVING A SLIDER WHICH CONNECTS WITH A CAP UPON THE SLIDER BEING INSERTED INTO A HOUSING TO LATCH THE CAP TO THE HOUSING

CROSS-REFERENCE TO RELATED APPLICATIONS

This application is a continuation of International Application PCT/EP2007/063690, published in German, with an international filing date of Dec. 11, 2007, which claims priority to DE 10 2006 058 680.8, filed Dec. 13, 2006; the disclosures of which are both hereby incorporated by reference.

BACKGROUND OF THE INVENTION

1. Field of the Invention

The present invention relates to an electrical plug connector having first and second connector housings and a slider insertable into the first housing in a direction perpendicular to the direction of insertion of the housings onto one another at a connecting side in which one of guide grooves or cams are on the slider and the other one of guide grooves or cams are on the second housing and in which when the slider is inserted into the first housing the cams are guided along the guide grooves and cause a relative displacement of the housings towards each other, and in which a lockable cap closes the side of the first housing lying opposite the connecting side.

2. Background Art

DE 198 44 693 A1 (corresponding to U.S. Pat. No. 6,213,795) describes an electrical plug connector in which a cap is connected to a connector housing by latches. The latching connection between the cap and the housing is a positive lock, but can be released by relatively small force. Such force can be produced by a wire harness introduced through a side opening of the cap to connect with connectors of the housing. The harness is relatively rigid due to the many conductors to be connected and can transmit significant lever forces to the cap upon transversely deflecting in a region offset from the connector. This is especially true when the harness is connected mechanically with the cap to achieve strain relief. Such force can loosen or destroy the latching connection between the cap and the housing.

SUMMARY OF THE INVENTION

An object of the present invention is an electrical plug and socket connector having a connector housing and a cap in which a particularly stable fastening of the cap to the housing is enabled.

In carrying out the above object and other objects, the present invention provides a connector having a first housing, a slider, and a cap. The slider has a pair of parallel slider surfaces insertable into the first housing in a direction transverse to a direction of insertion of a second housing to the first housing at a connecting side of the first housing. The cap is on a cap side of the first housing lying opposite to the connecting side of the first housing. The slider surfaces connect with the cap to latch the cap to the cap side of the first housing upon the slider surfaces being inserted into the first housing.

In embodiments of the present invention, the slider surfaces of the slider are positively locked to the cap when the slider is inserted into the first housing. That is, the slider surfaces are locked to the cap by inserting the slider surfaces into the first housing. The slider surfaces have receptacle grooves that slide over locking hooks of the cap when the slider surfaces are inserted into the first housing.

The locking hooks are molded to the cap and have the external shape of latching hooks. However, the locking hooks are significantly more rigid and stable than conventional latching hooks. This is because the positively locked connection between the cap and the first housing is produced by insertion of the locking hooks of the cap into the receptacle grooves of the slider surfaces, or, alternatively, the sliding of the receptacle grooves over the locking hooks. In either case, the locking hooks do not have to overcome any latching barrier. An extremely stable connection between the cap and the slider (the slider surfaces) can thereby be created with the locking hooks. This results in an extremely stable connection between the cap and the first housing with this connection being able to withstand large applications of force on the cap from the sides of a wire harness.

Accordingly, a wire harness can be fixed to the cap without difficulty, which has the advantage that movements of the wire harness, and in particular vibrational motions present in the engine space of a vehicle, are transmitted through the wire harness to the contact elements of the connector after being strongly attenuated. An especially high quality is thereby achieved for the electrical connections made through the connector.

The above features, and other features and advantages of the present invention are readily apparent from the following detailed descriptions thereof when taken in connection with the accompanying drawings.

DETAILED DESCRIPTION OF THE PREFERRED EMBODIMENT(S)

Figure 1:
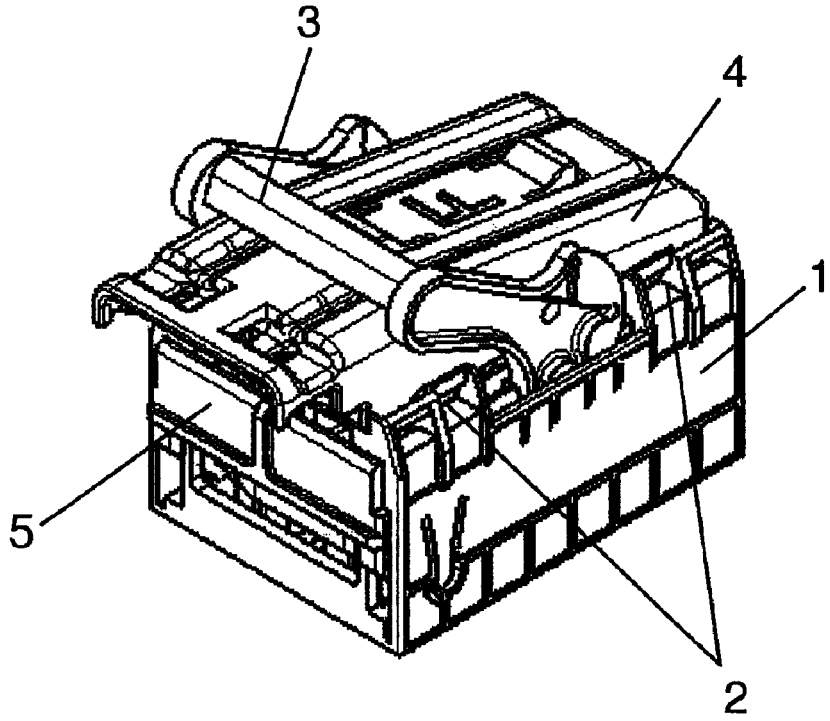
FIG. 1 illustrates a first connector housing, a slider, and a cap of an electrical plug and socket connector in accordance with an embodiment of the present invention in which the cap is in place on the housing and the slider is inserted into the housing.

Referring now to FIG. 1, a first connector housing 1, a slider 5, and a cap 4 of an electrical plug and socket connector in accordance with an embodiment of the present invention are shown. In FIG. 1, cap 4 is in place on first housing 1 and slider 5 is inserted into first housing 1.

Figure 2:
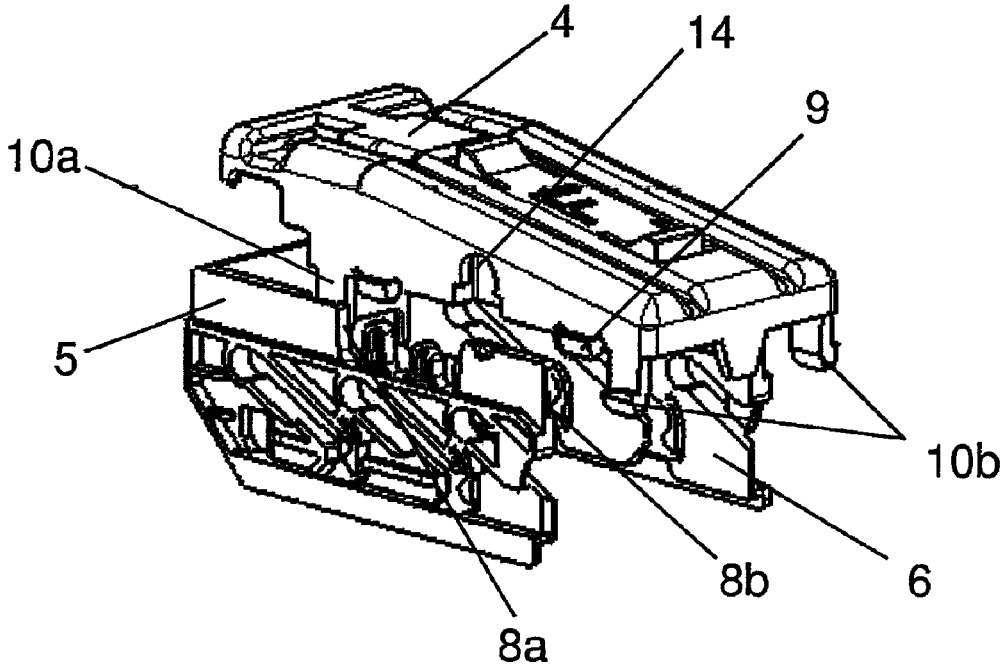
FIG. 2 illustrates the slider and the cap in an unlocked position relative to the housing.
Figure 3:
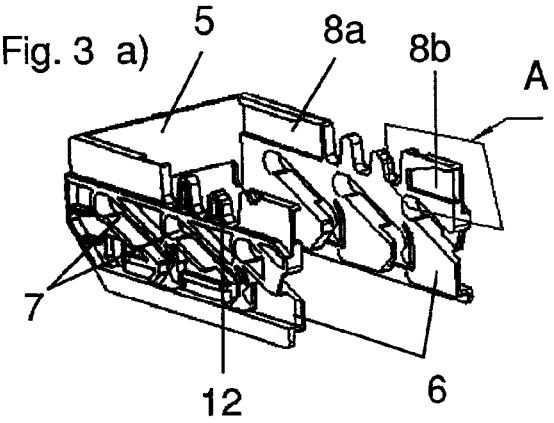
FIG. 3*a* illustrates the slider.
FIG. 3*b* illustrates the detail A in FIG. 3*a* of the slider.
Figure 3:
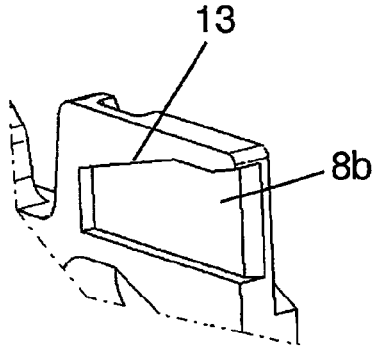
Figure 5:
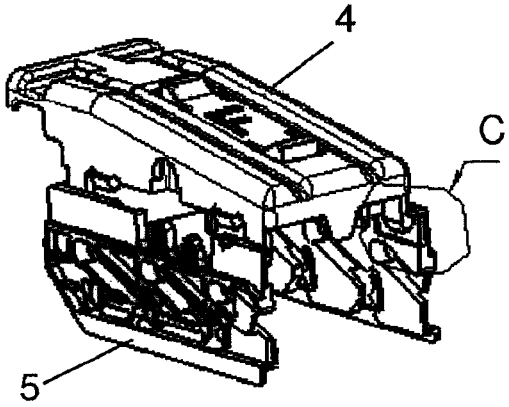
FIG. 5*a* illustrates the cap and the slider in the unlocked position.
FIG. 5*b* illustrates the detail C in FIG. 5*a* of the cap and the slider.
Figure 5:
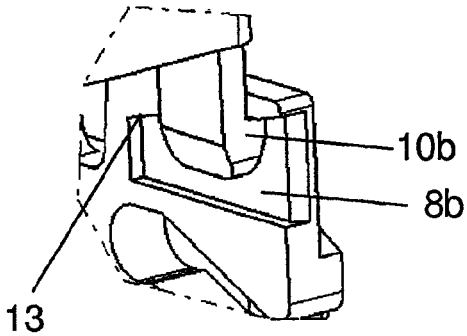

As shown in FIG. 3*a* (and in FIGS. 2 and 5), slider 5 includes two parallel slider surfaces 6. Slider surfaces 6 are connected to one another by a single molded connection surface. Slider 5 is thereby molded as a single U-shaped object in which side surfaces form slider surfaces 6.

As further shown in FIG. 3*a*, slider surfaces 6 respectively have a plurality of slanted guide grooves 7. In this case, slider surfaces 6 respectively have three slanted guide grooves 7. Slanted guide grooves 7 cooperate in the connection of first housing 1 with cams on a second connector housing of the electrical plug and socket connector. The cams of the second housing slide along guide grooves 7 by an insertion motion of slider surfaces 6 in a direction perpendicular to the direction of insertion of first housing 1 and the second housing onto one another at a connecting side whereby the housings undergo a relative closing motion with respect to one another and whereby plug elements are introduced from one of the housings into socket elements of the other one of the housings. As such, one of first housing 1 and the second housing is a plug connector housing and the other of first housing 1 and the second housing is a socket connector.

This type of joining of two connector housings such as first housing 1 and the second housing by a slider having two slider surfaces is described by DE 198 44 692 A1 and DE 195 11 225 C2 (corresponding to U.S. Pat. No. 5,618,194).

The insertion of slider 5 into first housing 1 can be assisted by mechanical means. To this end, first housing 1 includes a swiveling bow-like lever 3 having gear wheel sectors (not shown) in the region of its axis of rotation that extend respectively into gearing 12 on the upper side of slider surfaces 6. A swiveling motion of lever 3 thereby causes slider 5 to undergo a translation motion. In the end position shown in FIG. 1, lever 3 lies against and is mounted on cap 4 thereby forming a pre-mounted assembly.

With reference to FIG. 2, cap 4 includes latching recesses 14 into which the axis of rotation of lever 3 can be clipped in. Lever 3 can be pre-mounted on first housing 1 without affecting the accessibility of first housing 1. The assembly of contact elements connected with individual conductors of a wire harness is thereby simplified on first housing 1.

Figure 4:
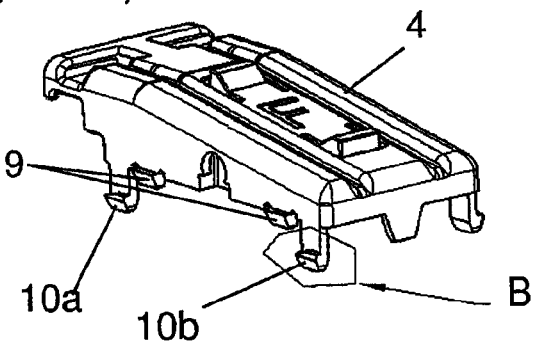
FIG. 4*a* illustrates the cap.
FIG. 4*b* illustrates the detail B in FIG. 3*b* of the cap.
Figure 4:
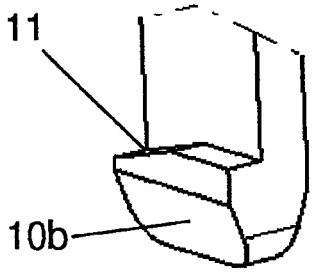

Cap 4 is positively locked with first housing 1 at the same time as slider 5 (i.e., slider surfaces 6) is moved into first housing 1. As shown in FIG. 3*a*, the upper sides of slider surfaces 6 include receptacle grooves 8*a*, 8*b* for this purpose. As shown in FIGS. 4*a* and 4*b*, cap 4 has two molded latching hooks 9 and two molded locking hooks 10*a*, 10*b* on each of its two longitudinal sides.

Cap 4 is connected to first housing 1 by pressing cap 4 onto the upper side of first housing 1 such that latching hooks 9 connect with latching recesses 2 of first housing 1. This latching connection holds cap 4 on first housing 1, but is not particularly stable with respect to shear forces exerted on cap 4.

Locking hooks 10*a*, 10*b* are longer and stronger than latching hooks 9. Locking hooks 10*a*, 10*b* penetrate recesses of first housing 1 to thereby penetrate into the plane of receptacle grooves 8*a*, 8*b* to slider surfaces 6.

Referring now to FIG. 2, an arrangement of cap 4 and slider 5 are shown. First housing 1 and lever 3 are purposely left out of FIG. 2 in order to highlight the cooperation of receptacle grooves 8*a*, 8*b* of slider 5 and locking hooks 10*a*, 10*b* of cap 4. First housing 1 would be located just below cap 4 with cap 4 being connected with first housing 1 by latching hooks 9. The position shown for slider surfaces 6 hereby corresponds to a pre-latching position in which slider 5 is partially, but not yet completely, inserted into first housing 1.

In the partially inserted position shown in FIG. 2, the first pair of locking hooks 10*a* lies just at the beginning of the corresponding first pair of receptacle grooves 8*a* while the second pair of locking hooks 10*b* is positioned in front of the corresponding second pair of receptacle grooves 8*b*.

When slider 5 is pushed relative to cap 4, first locking hooks 10*a* on respective longitudinal sides of cap 4 slide along first receptacle grooves 8*a* of respective slider surfaces 6 until second locking hooks 10*b* on respective longitudinal sides of cap 4 push through second receptacle grooves 8*b* of respective slider surfaces 6 and thereby stops slider 5. Locking hooks 10*a*, 10*b* are completely stopped when slider 5 is completely inserted into first housing 1 (shown in FIG. 1). The position of cap 4 attained at that time relative to slider 5 is shown in FIG. 5*a*.

With reference to FIG. 4*b*, locking hooks 10*a*, 10*b* have chamfers 11. Chamfers 11 simplify sliding receptacle grooves 8*a*, 8*b* over locking hooks 10*a*, 10*b*. Furthermore, chamfers 11 cause locking hooks 10*a*, 10*b* to remain under a slight mechanical tension after insertion into receptacle grooves 8*a*, 8*b* and thus enables cap 4 to be mounted without play.

Receptacle grooves 8*a*, 8*b* may be formed as bevels 13, as shown in FIG. 3*b*, to match the shape of chamfers 11 of locking hooks 10*a*, 10*b*. As is shown in FIG. 5*b*, locking hooks 10*b* have a particularly stable attachment to bevels 13.

As locking hooks 10*a*, 10*b* are designed to be especially rigid, and are furthermore stabilized by the execution inside first housing 1, they form a nearly inelastic positive locking connection with receptacle grooves 8*a*, 8*b*, which is practically impossible to release without drawing slider 5 back into the pre-latching position shown in FIG. 2. This results in an extremely stable attachment of cap 4 on first housing 1, whereby it is possible to achieve a stable attachment of a wire harness to cap 4. The connection of the wire harness to cap 4 can thereby be carried out in a simple and advantageous manner by one or a plurality of cable ties. The stable connection of the wire harness furthermore enables a secure electrical connection between first housing 1 and the second housing of the electrical plug and socket connector.

REFERENCE LIST

1 (First) Plug and socket connector housing
2 Latching recesses
3 Lever
4 Cap
5 Slider
6 Slider surfaces
7 Guide grooves
8*a*, 8*b* Receptacle grooves
9 Latching hooks
10*a*, 10*b* Locking hooks
11 Chamfers
12 Gearing
13 Bevels
14 Latching recesses While embodiments of the present invention have been illustrated and described, it is not intended that these embodiments illustrate and describe all possible forms of the present invention. Rather, the words used in the specification are words of description rather than limitation, and it is understood that various changes may be made without departing from the spirit and scope of present the invention.

What is claimed is:

1. A connector comprising:

a first housing;

a U-shaped slider having a connection surface and a pair of parallel slider surfaces, each of the slider surfaces connected at one end to the connection surface, each of the slider surfaces having a receptacle groove, the slider being insertable into the first housing in a direction transverse to a direction of insertion of a second housing to the first housing at a connecting side of the first housing, wherein the slider is connected to the first housing upon the slider surfaces being inserted into the first housing such that the slider surfaces insert into the first housing upon the slider being inserted into the first housing; and a cap on a cap side of the first housing lying opposite to the connecting side of the first housing, the cap having a pair of parallel sides with each side of the cap having a locking hook;

wherein the slider surfaces connect with the cap by the receptacle grooves respectively sliding over the locking hooks to latch the cap to the cap side of the first housing upon the slider surfaces being inserted into the first housing.

2. The connector of claim 1 wherein:

each side of the cap has a latching hook;

the first housing has a pair of parallel sides with each side of the first housing having a latching recess;

wherein the latching hooks connect with the latching recesses upon the cap being pressed onto the cap side of the first housing to connect the cap to the cap side of the first housing.

3. The connector of claim 2 wherein:

the locking hooks are longer than the latching hooks.

4. The connector of claim 1 wherein:

each locking hook has a chamfer to facilitate the sliding of the receptacle grooves over the locking hooks upon the slider surfaces being inserted into the first housing.

5. The connector of claim 4 wherein:

each receptacle groove is formed as a bevel matching the shape of the chamfer of the corresponding locking hook.

6. The connector of claim 1 further comprising:

a lever rotationally mounted to the cap and having gear wheel sectors extending respectively into gearing of the slider surfaces such that swiveling motion of the lever thereby causes the slider to move in the transverse direction into the first housing.

7. The connector of claim 6 wherein:

the lever forms a pre-mounted subassembly with the cap.

* * * * *